US007771813B2

(12) United States Patent
Akishev et al.

(10) Patent No.: US 7,771,813 B2
(45) Date of Patent: Aug. 10, 2010

(54) SANDWICH PANEL CORE

(75) Inventors: Niaz Irekovich Akishev, Kazan (RU); Ildus Muhametgaleevich Zakirov, Kazan (RU); Alexandr Vladimirovich Nikitin, Kazan (RU)

(73) Assignees: Airbus, Blagnac (FR); Otkrytoe Aktsionernoe Obschestvo "Kazansky Nauchno-Isledovatelsky Institut Aviatsionnoi Tekhnologii", Kazan (RU)

( * ) Notice: Subject to any disclaimer, the term of this patent is extended or adjusted under 35 U.S.C. 154(b) by 521 days.

(21) Appl. No.: 10/582,228

(22) PCT Filed: Dec. 11, 2003

(86) PCT No.: PCT/RU03/00552

§ 371 (c)(1),
(2), (4) Date: Jun. 9, 2006

(87) PCT Pub. No.: WO2005/056285

PCT Pub. Date: Jun. 23, 2005

(65) Prior Publication Data

US 2007/0098960 A1 May 3, 2007

(51) Int. Cl.
*B32B 3/24* (2006.01)

(52) U.S. Cl. ..... 428/140; 428/139; 428/116

(58) Field of Classification Search ..... 428/139, 428/140, 116

See application file for complete search history.

(56) References Cited

U.S. PATENT DOCUMENTS

| | | | | |
|---|---|---|---|---|
| 3,767,498 | A * | 10/1973 | Sharp et al. | 156/94 |
| 4,150,186 | A | 4/1979 | Kazama | |
| 4,647,063 | A | 3/1987 | Piringer et al. | |
| 4,877,671 | A * | 10/1989 | Stagg et al. | 428/139 |
| 6,815,022 | B2 * | 11/2004 | Renck et al. | 428/34.3 |
| 2007/0141276 | A1 * | 6/2007 | Alihodzic et al. | 428/13 |
| 2007/0148412 | A1 * | 6/2007 | Akishev et al. | 428/182 |

FOREIGN PATENT DOCUMENTS

RU 2 057 647 C1 4/1996

OTHER PUBLICATIONS

V. I. Khaliulin, "Technological schemes for sandwich structures production", KSTU, Kazan, 1999.—168 p., p. 40-44.—ISBN 5-7579-0295-7.

* cited by examiner

*Primary Examiner*—William P Watkins, III
(74) *Attorney, Agent, or Firm*—Oblon, Spivak, McClelland, Maier & Neustadt, L.L.P.

(57) ABSTRACT

The invention can be defined in its most general form as a 3-D light core from sheet material, especially from "NOMEX" polymeric paper, and can be used in production of sandwich panels as applied in aircraft production, construction and other branches of industry. With the aim to improve the core mechanical and unit weight properties, the paper base is perforated thereby increasing the base-binder bonding strength, whereof the binder is applied onto both sides of the base to increase its structure rigidity, owing to bonding of binder layers in-between at the locations of the holes. The quantity of the holes and their diameter are defined in a formula.

5 Claims, 2 Drawing Sheets

SANDWICH PANEL CORE

TECHNICAL FIELD

Our invention can be defined in its most general form as a 3-D light core from sheet material, especially from polymeric "NOMEX" paper, and can be used in production of sandwich panels as applied to aircraft production, construction and other branches of industry.

BACKGROUND ART

Known is a folded core made from synthetic fabric (glass fabric, carbon fabric, etc.) with applied onto the parts forming core lateral ridges and hot-pressed binder (RF Pat. No. 2,057, 647 C1. Method for production of core from composite material.—Int. Cl: B 29 D 9/00.—Bulletin no. 10 of Oct. 4, 1996).

The main short-coming of herein-presented core is its labor-consuming production and the necessity of sophisticated equipment for discrete impregnation of fabric.

Known is a sandwich panel core made from sheet polymeric material, e.g. from "Phenylone" polyamide paper, impregnated from its both sides (with binder) (V. I. Khaliulin, Technological schemes for sandwich structures production, KSTU, Kazan, 1999.—168 p., p. 40-44.—ISBN 5-7579-0295-7).

The main short-coming of herein-presented core is the weighting of panel structure due to increasing of the applied binder (having relatively high density) mass up to that of comparable with the paper base mass to provide the core mechanical properties required.

DISCLOSURE OF INVENTION

Our invention has for its object to increase the mechanical properties of light core from sheet materials owing to base-binder bonding strength hardening and decrease of the applied binder mass.

The technical result attained at executing of the claimed invention is an increase of aircraft efficiency owing to improvement of sandwich panels unit weight properties used in airframe.

The stated technical result is attained by that the sandwich panel core being a 3-D structure, especially from polymeric paper with binder applied onto its both sides, includes the paper base perforated, e.g. with the use of multi-beam laser, whereof the quantity of the holes and their diameter satisfy the condition $$n_h \cdot \frac{\pi \cdot d_h^2}{4} > \frac{2 \cdot \Delta_b \cdot F}{\delta_p\left(1 - \frac{\rho_p}{\rho_b}\right)}, \text{ where}$$

$n_h$ is the quantity of holes, $d_h$ is the diameter of holes, $\Delta_b$ is the binder layer thickness decrease as compared to the prototype, F is the core surface area, $\delta_p$ is the base layer thickness, $\rho_p$ is the paper base material density, $\rho_b$ is the binder density.

The undertaken by the applicant state of the art analysis shows that there are no analogs characterized by the combination of the features identical to those of the invention.

Therefore, the claimed technical solution satisfies the "novelty" condition of patentability.

The results of retrieval for the known solutions in the given area with the aim to reveal the features identical with distinctions of the claimed technical solution show that its features do not result from the state of the art. From the defined state of the art the applicant managed to reveal no influence of the specified essential features upon the attainment of the stated technical result. The claimed technology, therefore, satisfies the "inventive step" condition of patentability.

BRIEF DESCRIPTION OF DRAWINGS

The FIGS. 1-4 present the essence of the invention.

Figure 1:
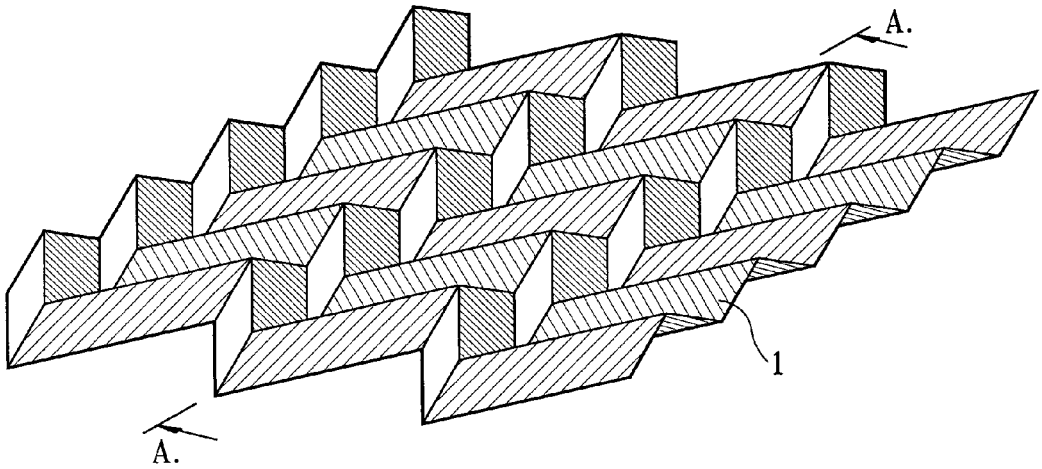
FIG. 1 is a general view sandwich panel folded core.
Figure 2:
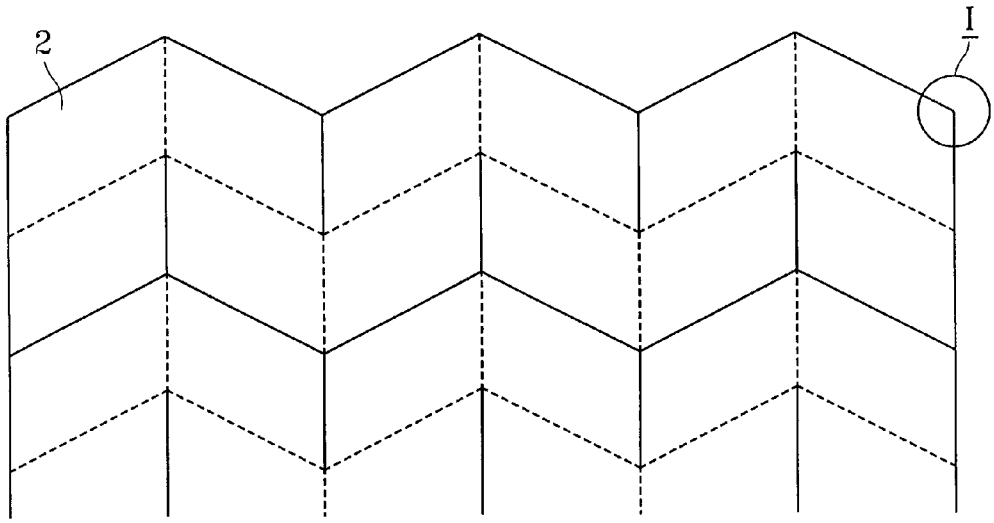
FIG. 2 shows the core blank plane sheet.
Figure 3:
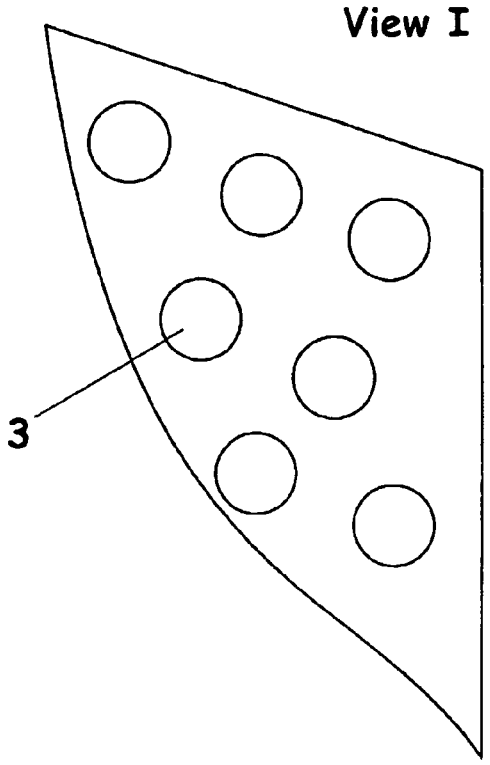
FIG. 3 is a blank fragment with perforation.
Figure 4:
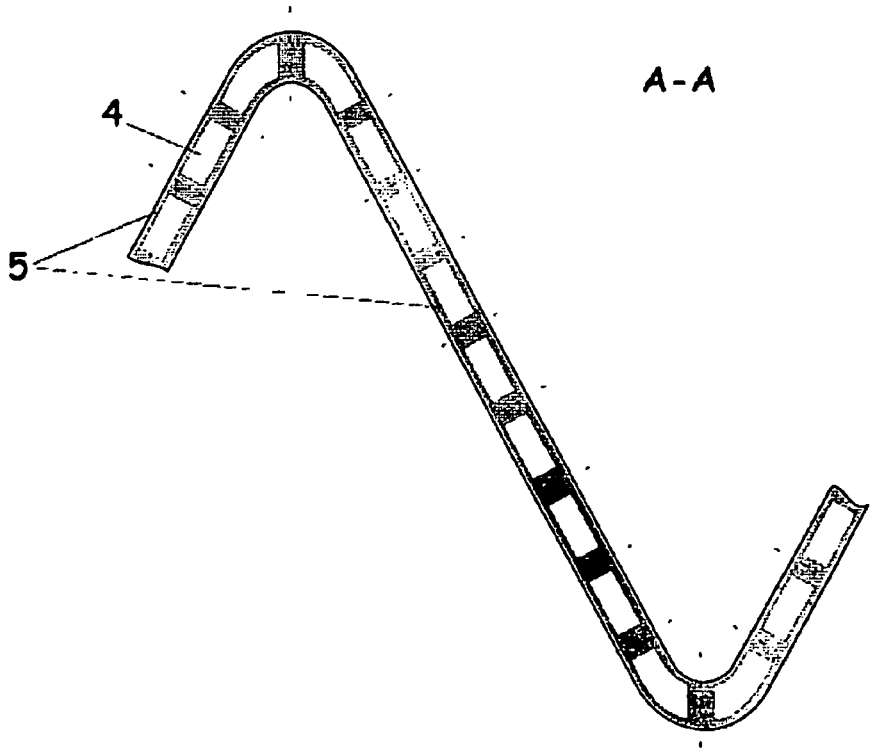
FIG. 4 is a sectional view A-A of FIG. 3.

The FIGS. 1-4 present the following positions:

1 is the ready-made core, 2 is the perforated blank, 3 are the through-holes in the blank material, 4 is the core base material (polymeric "NOMEX" paper), 5 is the binder layer.

BEST MODE FOR CARRYING OUT THE INVENTION

Sandwich panel core is a 3-D structure 1 formed by blank 2, e.g. from polymeric "NOMEX" paper, folded in a peculiar manner owing to bending along the marking-out lines. With the aim to increase the structure strength, the blank 2 has on its both sides a coating formed by binder layers 5 on the basis of, e.g. phenol-formaldehyde resin, applied onto the paper surface in its liquid state and thermally hardened. Since the polymeric paper has a relatively low adhesion to phenolic binders, the blank 2 of the core 1 is perforated before binder application and shaping wherewith the binder layers bond in-between at locations of the holes 3 therefore forming 3-D structure working as a single whole in the core structure. It allows to increase the strength and rigidity of the core structure, or to decrease the total thickness of binder layers under the strength given, and, therefore, to decrease its mass; finally, it allows to improve the unit weight properties of sandwich panels, used in airframes, with the core given.

INDUSTRIAL APPLICABILITY

The economic effect of the claimed technical solution is obtained at decrease of the binder layers total thickness 3 providing the decrease of layers quantity, the reduction of power inputs for layer-by-layer hardening of the applied binder, and therefore the extension of the core production outputs.

The invention claimed is:

1. A sandwich panel core, wherein the core is a 3-D structure formed from a sheet of polymeric paper, a binder layer is applied onto both sides of the sheet, the sheet includes perforation holes, and the binder layers bond to each other at a location of the perforation holes wherein said 3-D structure is formed by a multiplicity of folds about zigzag bend lines and said perforation holes are arranged at and between adjacent bend lines.

2. The sandwich panel core according to claim 1, wherein the binder layers are made of phenol-formaldehyde resin.

3. The sandwich panel core according to claim 1, wherein a top binder layer has an inner surface bonded to the paper, and an outer unbonded surface.

4. The sandwich panel core according to claim 1, wherein a bottom binder layer has an inner surface bonded to the paper, and an outer unbonded surface.

5. The sandwich panel core according to claim 1, formed by a process comprising:

applying binder layers to both sides of the paper in a liquid state;

bonding the binder layers to each other at locations of the perforation holes; and thermally hardening the binder layers.

* * * * *